US005682646A

United States Patent [19]

Tyler, IV et al.

[11] Patent Number: 5,682,646

[45] Date of Patent: Nov. 4, 1997

[54] THREADED REMOVABLE VEHICLE DOOR HINGE PIN

[75] Inventors: Thomas F. Tyler, IV, Farmington Hills; Joseph J. Savalle, Dearborn, both of Mich.; Brett A. Johnson, Chesterfield, Mo.; Henry J. Ziaja, Dearborn, Mich.; Terrence W. Gillay, Bloomfield Twp., Mich.; Earl L. Watson, Walled Lake, Mich.

[73] Assignee: Chrysler Corporation, Auburn Hills, Mich.

[21] Appl. No.: 645,161

[22] Filed: May 13, 1996

[51] Int. Cl.[6] ..... E05D 5/12; E05D 7/10

[52] U.S. Cl. ..... 16/386; 16/381; 16/264

[58] Field of Search ..... 16/386, 380, 381, 16/270, 264, 266, 340

[56] References Cited

U.S. PATENT DOCUMENTS

| | | | |
|---|---|---|---|
| 658,621 | 9/1900 | Dalzell . | |
| 746,272 | 12/1903 | Bommer . | |
| 1,429,416 | 9/1922 | Fade . | |
| 1,478,706 | 12/1923 | Forker . | |
| 1,782,582 | 11/1930 | Raymond | 16/381 |
| 1,805,324 | 5/1931 | Bird | 16/381 |
| 1,936,769 | 11/1933 | Olivet | 16/169 |
| 2,797,433 | 7/1957 | Hager, Jr. | 16/381 |
| 2,987,757 | 6/1961 | Okner | 16/381 |
| 3,198,563 | 8/1965 | Steidl | 287/96 |
| 3,593,365 | 7/1971 | Amundsen | 16/380 |
| 4,078,276 | 3/1978 | Nunes | 16/381 |
| 4,475,266 | 10/1984 | Suska | 16/273 |
| 4,720,895 | 1/1988 | Peebles | 16/264 |
| 4,748,718 | 6/1988 | Harrison | 16/254 |
| 4,800,623 | 1/1989 | Brockhaus | 16/254 |
| 4,864,687 | 9/1989 | Calcaterra et al. | 16/334 |
| 4,864,689 | 9/1989 | Brockhaus | 16/262 |
| 4,979,263 | 12/1990 | Tolle | 16/262 |
| 5,297,314 | 3/1994 | Bender et al. | 16/270 |

FOREIGN PATENT DOCUMENTS

| | | | |
|---|---|---|---|
| 3609820 | 10/1986 | Germany . | |
| 1332913 | 10/1973 | United Kingdom | 16/381 |

*Primary Examiner*—Chuck Y. Mah

*Attorney, Agent, or Firm*—Roland A. Fuller, III

[57] ABSTRACT

A vehicle door hinge assembly according to this invention has a hinge bracket for mounting on each of a door and a body pillar of a vehicle. Each hinge bracket has a pair of spaced-apart legs wherein the pair of legs of one hinge bracket is received within and adjacent the pair of spaced-apart legs of the other bracket when the hinge brackets are hingedly mated together. The hinge brackets have aligned holes formed through their respective pairs of legs through which a hinge pin is received to hingedly mate the two hinge brackets together. The improvement comprises the hinge pin having a threaded tip or end and one of the legs of the outer hinge bracket having a nut affixed thereto in coaxial relation to the hole formed therein, or a the hole therein being threaded, and the threaded end of the hinge pin screwed therein when the hinge pin is inserted in the holes in the respective pairs of legs of the hinge brackets to hingedly mate the hinge brackets together.

6 Claims, 2 Drawing Sheets

THREADED REMOVABLE VEHICLE DOOR HINGE PIN

This invention relates to vehicle hinge assemblies, and more particularly to an improved hinge pin and retention therefor.

BACKGROUND OF THE INVENTION

Vehicle door hinge assemblies conventionally comprise two brackets, one which attaches to a body pillar of the vehicle and the other which attaches to a door of the vehicle. Each bracket has a pair of opposed legs or hinge leafs. One bracket is an outer bracket and the other an inner bracket wherein the pair of legs of the inner bracket is received within and adjacent to the pair of legs of the outer bracket when the two brackets are hingedly mated together. The two brackets are hingedly mated together by a hinge pin which extends through vertically aligned holes (when the vehicle hinge assembly is mounted to the vehicle) formed in the legs of the brackets.

One type of known vehicle hinge assembly has a removable hinge pin that permits the vehicle door to be removed and reinstalled as needed during the vehicle assembly process. Conventionally, this removable hinge pin is secured in place by a push-nut, slip ring, or the like that is pushed onto the end of the hinge pin and into a recess formed therein.

A problem with this type of removable hinge pin is that special tools are needed to install the push-nut or to remove it. Since the hinge pin may need to be installed or removed at various points in the vehicle assembly process, multiple sets of these special tools are needed.

It is an object of this invention to provide an improved vehicle door hinge assembly having a removable hinge pin with a threaded tip or end that screws into a nut affixed about the hole in one leg of the outer bracket of the vehicle hinge assembly.

SUMMARY OF THE INVENTION

A vehicle door hinge assembly according to this invention has a two hinge brackets, one for mounting to a door and one for mounting to a body pillar of a vehicle. Each hinge bracket has a pair of spaced-apart legs. One hinge bracket is an outer hinge bracket and the other is an inner hinge bracket wherein the pair of legs of the inner hinge bracket is received within and adjacent the pair of spaced-apart legs of the outer hinge bracket when the hinge brackets are hingedly mated together. The hinge brackets have aligned holes formed through their respective pairs of legs through which a hinge pin is received to hingedly mate the two hinge brackets together. The improvement comprises the hinge pin having a threaded tip or end and one of the legs of the outer hinge bracket having a nut affixed thereto in coaxial relation to the hole formed therein, or the hole therein being threaded, and the threaded end of the hinge pin screwed therein when the hinge pin is inserted in the holes in the respective pairs of legs of the hinge brackets to hingedly mate the hinge brackets together.

BRIEF DESCRIPTION OF THE DRAWINGS

Additional features and advantages of the invention will become apparent to those skilled in the art upon consideration of the following detailed description of a preferred embodiment exemplifying the best mode of carrying out the invention as presently perceived. The detailed description particularly refers to the accompanying figures in which.

DETAILED DESCRIPTION OF THE DRAWINGS

Figure 1:
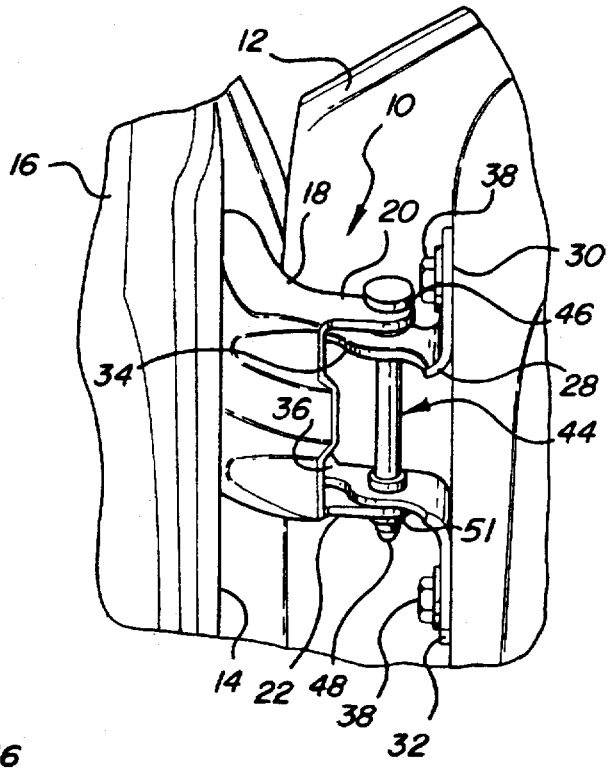
(PRIOR ART) FIG. 1
FIG. 1 is a fragmentary perspective view of a vehicle body and door having a prior art door hinge assembly.
Figure 2:
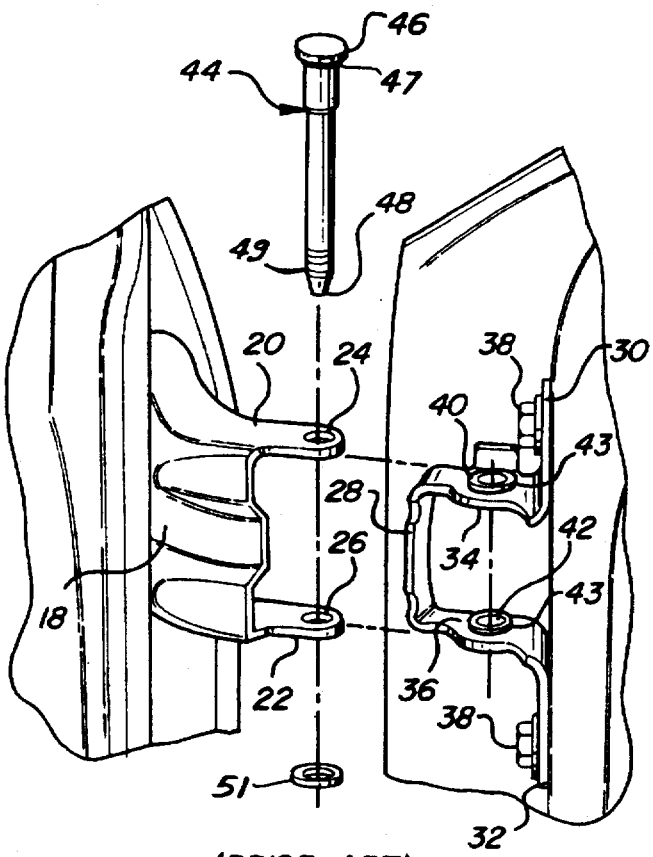
(PRIOR ART) FIG. 2
FIG. 2 is an exploded view of FIG. 1.

Referring to FIGS. 1 and 2, a prior art vehicle door hinge assembly 10 operatively interconnecting a door 12 to a pillar 14 of a vehicle body 16 is shown. The hinge assembly 10 includes a first bracket 18 secured by bolts (not shown) to the pillar 14. Upper and lower legs 20 and 22, respectively, extend outwardly from the bracket 18. Vertically aligned holes 24 and 26 (FIG. 2) are formed in the respective legs 20 and 22.

The hinge assembly 10 further includes a second bracket 28, which is U-shaped, with planar perforated mounting flanges 30 and 32 formed on the ends of respective legs 34 and 36. The perforated flanges 30 and 32 are secured to an edge of the door 12 by bolts 38. Vertically aligned holes 40 and 42 (FIG. 2) are formed through the respective upper and lower legs 34 and 36. Suitable bushings 43 may be mounted in the holes 40 and 42.

The respective pairs of legs 20,22 and 34,36 are spaced apart such that the latter legs mount inside the former legs upon the mounting of the door 12 on the pillar 14. The locations of the pairs of holes 24,26 and 40,42 are such that all four are substantially aligned during the door mounting process.

A hinge pin 44 extends downwardly through the holes 24, 40, 26 and 42 to maintain a pivotal relatively tight fitting butt relationship between the door 12 and the vehicle body 16. Hinge pin 44 has a flanged head 46, a staked knurl 47 immediately beneath flanged head 46, and a tapered and blunt lower end 48 for piloting through the holes 24, 40, 26 and 42. Tapered and blunt lower end 48 is formed to have a recess 49 therein.

During the vehicle assembly process, hinge pin 44 is inserted through the holes 24, 40, 26 and 42 in legs 20, 22 and 34, 36 of brackets 18, 28 to hingedly mate the vehicle door 12 to vehicle body 16. At the appropriate time in the assembly process, hinge pin 44 is secured in place by pushing a push-nut 51 onto the end 48 of hinge pin 44 and into recess 49. Hinge pin 44 is held in place by knurl 47, which butts against a top surface of leg 20 of bracket 18, and push-nut 51. A special tool (not shown) of the type readily known in the automotive industry is used to push-nut 51 onto end 48 of hinge pin 44 and into recess 49. Also, should it become necessary to remove push-nut 51 from hinge pin 44, another special tool (not shown) of the type readily known in the automotive industry is used.

Figure 3:
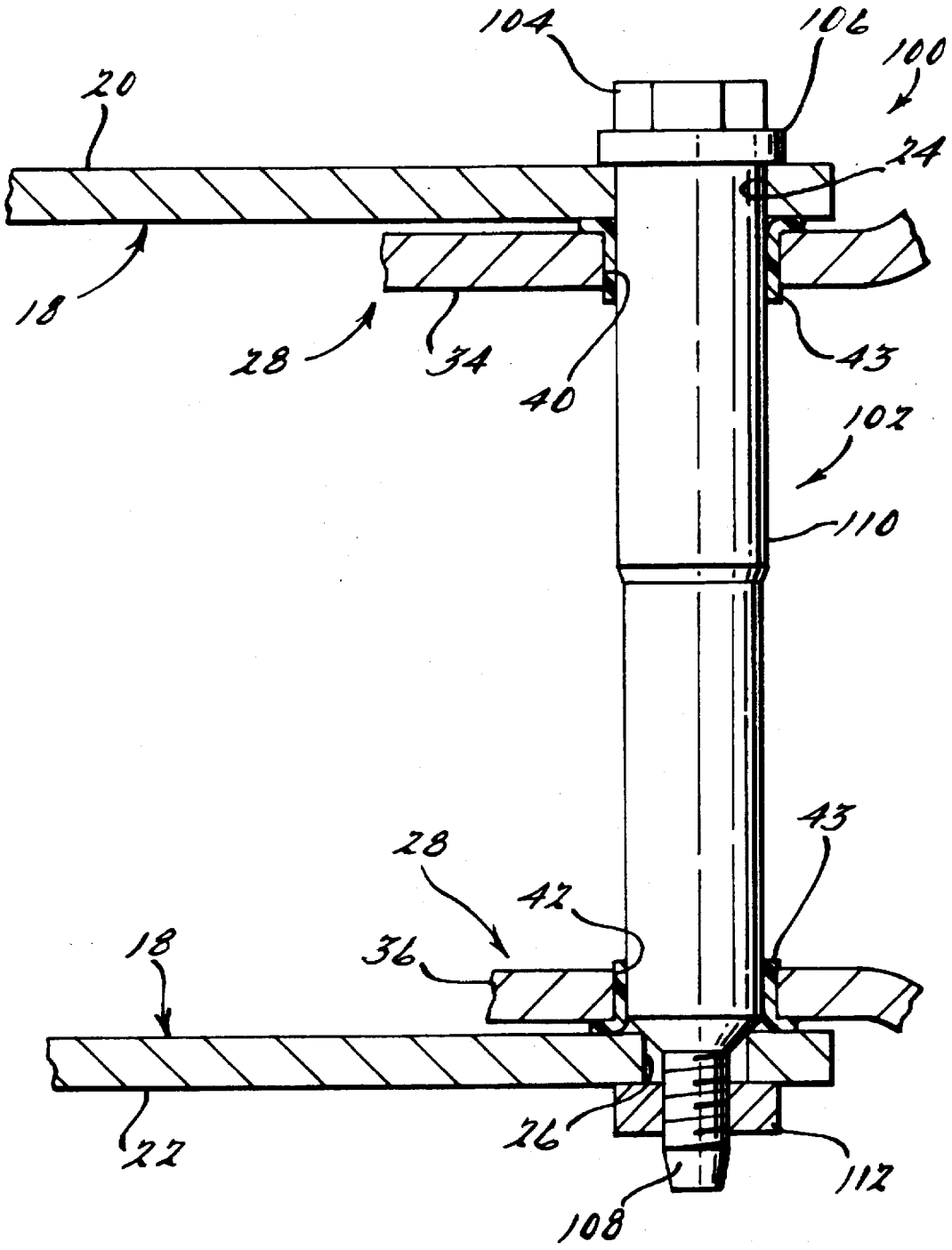
FIG. 3 is a partially cross-sectional, partially perspective view of the door hinge of this invention.

Referring to FIG. 3, the improved door hinge assembly 100 of this invention is shown. Like parts between FIG. 3 and FIGS. 1 and 2 are numbered with like reference numbers. Only the differences between improved hinge assembly 100 and the prior art hinge assembly 10 will be discussed.

In the illustrative embodiment of FIG. 3, the improved hinge assembly 100 has an improved hinge pin 102. Hinge pin 102 has a hex-head 104 having a circumferential flange 106, a threaded tip 108, and a shaft 110 extending therebetween. Leg 22 of first bracket 18 has a nut 112 affixed thereto beneath hole 26 and in coaxial relation therewith. Nut 112 is illustratively a step nut. Although the embodiment of FIG. 3 discloses nut 112, an alternative to the use of nut 112 is to make hole 26 a threaded hole.

When hinge pin 102 is inserted in holes 24, 26, 40, 42 of first bracket 18 and second bracket 28, it is affixed in place by tightening threaded tip 108 in nut 112 at which time the first and second brackets 18, 28 are captured between the circumferential flange 106 of hinge pin 104 and nut 112. As can be seen, circumferential flange 106 has a diameter larger than the holes 24, 26, 40, 42 in the legs 20, 22, 34, 36 of first and second brackets 18, 28. A conventional nut driver placed over hex-head 104 can be used to tighten threaded tip 108 of hinge pin 102 in nut 108. Further, while hex-head 104 of hinge pin 102 is shown as a hex-head, alternatives such as Allen heads, conventional screw slots (standard or Phillips), Torx and the like can also be used. Also, while circumferential hinge 106 is shown as formed as part of hinge pin 102, a washer or the like could also be used to provide circumferential flange 106.

Although the invention has been described in detail with reference to certain preferred embodiments and specific examples, variations and modifications exist within the scope and spirit of the invention as defined in the following claims.

What is claimed is:

1. In a vehicle door hinge assembly including a first hinge bracket for mounting on a door and a second hinge bracket for mounting on a body pillar of a vehicle, each hinge bracket having a pair of spaced-apart legs, one of said first and second hinge brackets comprising an outer hinge bracket and the other comprising an inner hinge bracket wherein the pair of legs of the inner hinge bracket is received within and adjacent the pair of spaced-apart legs of the outer hinge bracket when the first and second hinge brackets are hingedly mated together, the first and second hinge brackets having aligned holes formed through their respective pairs of legs through which a hinge pin is received to hingedly mate the two hinge brackets together, the improvement comprising a nut affixed to one of the legs of the outer hinge bracket in coaxial relation to the hole in that leg, and the hinge pin having a threaded tip at one end that is threadably received in the nut for tightening therein.

2. The vehicle door hinge assembly of claim 1 wherein the hinge pin has a hex-head end opposite the end having the threaded tip.

3. The vehicle door hinge assembly of claim 2 wherein the hex-head end further has a circumferential flange at generally the bottom thereof, the circumferential flange having a diameter larger than the holes in the legs.

4. In a vehicle door hinge assembly including a first hinge bracket for mounting on a door and a second hinge bracket for mounting on a body pillar of a vehicle, each hinge bracket having a pair of spaced-apart legs, one of said first and second hinge brackets comprising an outer hinge bracket and the other comprising an inner hinge bracket wherein the pair of legs of the inner hinge bracket is received within and adjacent the pair of spaced-apart legs of the outer hinge bracket when the first and second hinge brackets are hingedly mated together, the first and second hinge brackets having aligned holes formed through their respective pairs of legs through which a hinge pin is received to hingedly mate the two hinge brackets together, the improvement comprising the hole in one of the legs of the outer hinge bracket being threaded, and the hinge pin having first end having a threaded tip that is threadably received in the threaded hole for tightening therein.

5. The vehicle door hinge assembly of claim 4 wherein the hinge pin has a hex-head end opposite the end having the threaded tip.

6. The vehicle door hinge assembly of claim 5 wherein the hex-head end of the hinge pin further has a circumferential flange at generally the bottom thereof, the circumferential flange having a diameter larger than the holes in the legs.

* * * * *